US005909497A

United States Patent [19]

Alexandrescu

[11] Patent Number: 5,909,497

[45] Date of Patent: Jun. 1, 1999

[54] PROGRAMMABLE HEARING AID INSTRUMENT AND PROGRAMMING METHOD THEREOF

[76] Inventor: Eugène Alexandrescu, 97, rue de Bleury, Rosemère, Canada, J7A 4L9

[21] Appl. No.: 08/731,183

[22] Filed: Oct. 10, 1996

[51] Int. Cl.[6] ..... H04R 25/00

[52] U.S. Cl. ..... 381/312; 381/314; 381/323

[58] Field of Search ..... 381/312, 314, 381/315, 323, 320, 321, 60

[56] References Cited

U.S. PATENT DOCUMENTS

| | | | |
|---|---|---|---|
| 4,051,331 | 9/1977 | Strong et al. | 179/107 R |
| 4,425,481 | 1/1984 | Mangold et al. | 179/107 FD |
| 4,471,171 | 9/1984 | Kopke et al. | 179/107 R |
| 4,490,585 | 12/1984 | Tanaka . | |
| 4,508,940 | 4/1985 | Steeger . | |
| 4,596,900 | 6/1986 | Jackson | 179/2 A |
| 4,611,598 | 9/1986 | Hortmann et al. . | |
| 4,697,283 | 9/1987 | Lafrance et al. | 379/443 |
| 4,790,018 | 12/1988 | Preves et al. . | |
| 4,813,417 | 3/1989 | Soli et al. . | |
| 4,823,795 | 4/1989 | van den Honert . | |
| 4,837,832 | 6/1989 | Fanshel . | |
| 4,879,749 | 11/1989 | Levitt et al. . | |
| 4,947,432 | 8/1990 | Topholm | 381/68.2 |
| 4,989,251 | 1/1991 | Mangold . | |
| 5,016,280 | 5/1991 | Engebretson et al. . | |
| 5,077,800 | 12/1991 | Dupret et al. . | |
| 5,083,312 | 1/1992 | Newton et al. | 381/68.4 |
| 5,131,046 | 7/1992 | Killion et al. . | |
| 5,144,674 | 9/1992 | Meyer et al. . | |
| 5,226,086 | 7/1993 | Platt | 381/58 |
| 5,303,306 | 4/1994 | Brillhart et al. | 381/68 |
| 5,384,852 | 1/1995 | Scharen | 381/68 |
| 5,390,254 | 2/1995 | Adelman . | |
| 5,404,407 | 4/1995 | Weiss . | |
| 5,502,769 | 3/1996 | Gilbertson . | |
| 5,553,152 | 9/1996 | Newton | 381/68.6 |
| 5,600,728 | 2/1997 | Satre | 381/68.2 |
| 5,608,803 | 3/1997 | Magotra et al. | 381/68.2 |

FOREIGN PATENT DOCUMENTS

| | | | |
|---|---|---|---|
| 641239 | 4/1991 | Australia . | |
| 1261959 | 9/1989 | Canada . | |
| 2066441 | 8/1991 | Canada | A61K 11/08 |
| 2054136 | 5/1992 | Canada | H04R 25/00 |
| 2056036 | 6/1992 | Canada | H04R 25/02 |
| 2100015 | 1/1994 | Canada | H04R 25/00 |
| 2150220 | 9/1994 | Canada | H04R 25/00 |

(List continued on next page.)

*Primary Examiner*—Huyen Le
*Attorney, Agent, or Firm*—Baker & Botts, L.L.P.

[57] ABSTRACT

Disclosed is an improved hearing instrument of the type generally having a microphone having an input for receiving ambient audio signals and an output for generating an electrical signal corresponding to the audio signals, a signal processor having an audio channel input connected to the output of the microphone for receiving and processing the electrical signal to produce a processed electrical signal and an output for outputting the processed electrical signal, where the signal processor is programmable through a communication port, and a speaker having an input connected to the output of the signal processor and an output for generating an audio signal corresponding to the processed electrical signal. The improvement consists of an interface for wireless programming of the signal processor. The interface has a watchdog circuit and a switch operatively connected between the output of the microphone and the input of the signal processor, another switch operatively connected between the output of the signal processor and the input of the speaker and a programming interface operatively connected to the switch, to the other switch and to the communication port of the signal processor, for translating the program codes into a programming language compatible with the programming language of the signal processor in order to program the signal processor by communicating with the signal processor through the communication port. This improved hearing instrument includes both "analog" and "digital" hearing instruments, and can be programmed at a remote location from the offices of a hearing aid specialist, through any type of channel.

38 Claims, 7 Drawing Sheets

FOREIGN PATENT DOCUMENTS

| | | | |
|---|---|---|---|
| A 0335542 | 10/1989 | European Pat. Off. . | |
| 0341903 | 11/1989 | European Pat. Off. | H04R 25/00 |
| A 0448764 | 10/1991 | European Pat. Off. . | |
| 0585976 | 3/1994 | European Pat. Off. | H04R 25/00 |
| A 0715259 | 6/1996 | European Pat. Off. . | |
| 4418203 | 12/1995 | Germany . | |
| 6315031 | 11/1994 | Japan . | |
| WO 9115902 | 10/1991 | WIPO . | |
| 9320668 | 10/1993 | WIPO | H04R 25/00 |
| 9409604 | 4/1994 | WIPO | H04R 3/02 |
| 9422276 | 9/1994 | WIPO | H04R 25/00 |

PROGRAMMABLE HEARING AID INSTRUMENT AND PROGRAMMING METHOD THEREOF

FIELD OF THE INVENTION

The present invention relates to a programmable hearing instrument and to a method for programming such a hearing instrument.

DESCRIPTION OF THE PRIOR ART

Hearing aids have evolved considerably since their inception. Since around 1984, it has been possible to tailor the response parameters of a hearing instrument to the specific hearing impediment of the user for whom the instrument is being fitted. Such hearing aids are generally referred to as being programmable. Furthermore, the size of hearing aids has considerably diminished, and most users now wear what are generally referred to as "in-the-ear" hearing instrument.

However, means for programming these hearing instruments vary. Most often, the user has to go to a hearing aid specialist's office where the programming is done. A variety of hearing aids allow this, such as the interface module disclosed in U.S. Pat. No. 5,502,769. This patent discloses the use of an interface module which is connected by wires to the battery receptacle of the hearing aid, and incorporates electronic components and circuitry in the interface so that the components and circuitry does not have to be incorporated into the hearing aid or as part of the programming system.

Other hearing aids have been proposed where the programming is done wirelessly using radio frequencies or ultrasonic frequencies. However, these hearing aids are limited in their flexibility and can cause confusion to the user as he or she may not know which program is running at a given time. Furthermore, any extensive programming must be done at a hearing aid specialist's offices.

There are presently two types of programmable hearing aids available presently: "analog" hearing aids, where the response parameters are tailored using analog circuitry or the signal path and digital circuitry for the programming path, and "digital" hearing aids, where the response parameters are tailored using digital signal processing. The latter hearing aids may further include a plurality of response parameters within their signal processing means that can be changed by a user.

SUMMARY OF THE INVENTION

It is an object of the invention to provide an improved hearing instrument which includes a programming interface for receiving program codes, translating the program codes into a language compatible with the programming language of the hearing instrument, programming the hearing instrument with the translated program codes and transmitting programming information from the hearing instrument.

It is another object of the invention to provide a programming interface that uses the acoustic or electromagnetic channels of a hearing instrument to transfer the program codes to the hearing instrument.

It is a further object of the invention to provide a programming interface that uses a watchdog circuit inserted between the sound pressure level sensing means of a hearing instrument and the input of the sound processing means to monitor incoming program codes.

In accordance with the invention, these and further objects are achieved with an improved hearing instrument of the type comprising:

a sound pressure level sensing means having an input for receiving ambient audio signals and an output for generating an electrical signal corresponding to the audio signals;

a signal processing means having an audio channel input connected to the output of the sound pressure level sensing means for receiving and processing the electrical signal to produce a processed electrical signal, the processing means being programmable through a communication port and having an output for outputting the processed electrical signal; and an output transducer means having an input connected to the output of the signal processing means and an output for generating an audio signal corresponding to the processed electrical signal.

The improvement lies in that the instrument further comprises an interface for wireless programming of the programmable signal processing means, this interface comprising:

means for receiving program codes operatively connected between the output of the sound pressure level sensing means and the audio channel input of the signal processing means;

means for transmitting program codes operatively connected between the output of the signal processing means and the input of the output transducer means; and a programming interface operatively connected to the means for receiving program codes, to the means for transmitting program codes and to the communication port of the signal processing means, for translating the program codes into a programming language compatible with the programming language of the signal processing means in order to program the signal processing means by sending a signal to the communication port.

The means for receiving program codes preferably include a watchdog circuit and a switch, such that the watchdog circuit monitors the electrical signal corresponding to the ambient audio signals and sends a signal to the programming interface when program codes are being received. The programming interface switches the path of the electrical signal from the signal processing means to the programming interface so that it may receive the program codes, translate them into a language compatible with the programming language of the signal processing means and then program the signal processing means with the translated program codes through a communication port. When program codes are no longer being received, when the programming interface receives a code indicating that program codes are no longer being sent or when the programming interface determines that the program codes are not directed to it, the programming interface switches the path of the electrical signal from the programming interface to the signal processing means so that the signal processing means may resume processing the signal.

The invention also provides a method for programming an improved hearing instrument of the type mentioned above where the user does not need to be present at the hearing aid specialist's office. This method comprises the steps of:

encoding the program codes into a signal at a remote location;

sending a signal via a channel so that it may become part of the ambient audio signal for the hearing instrument;

monitoring the electrical signal corresponding to the ambient audio signal in order to determine if program codes are being received;

receiving the program codes with the means for receiving program codes;

sending the program codes from the means for receiving program codes to the programming interface;

translating the program codes with the programming interface into a language compatible with the signal processing means;

programming the signal processing means with the translated program codes by sending the translated program codes to the signal processing means through the communication port.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

Figure 1:
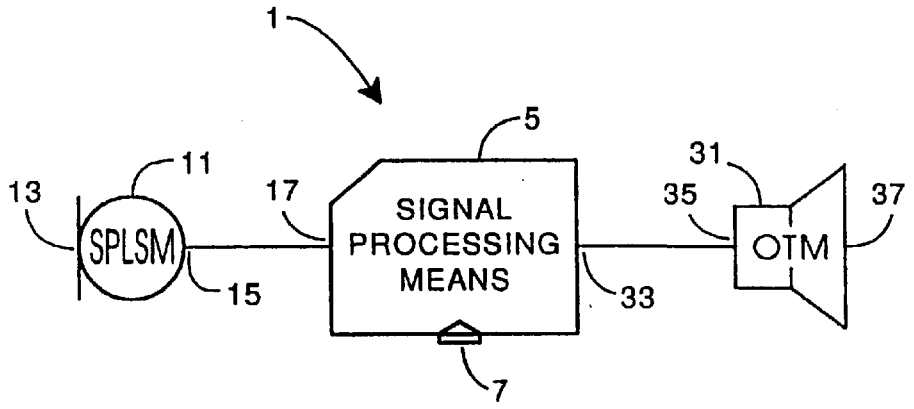
FIG. 1 ( PRIOR ART )
FIG. 1 is a schematic representation of a conventional hearing instrument.

FIG. 1 shows a block diagram of a hearing instrument 1 of conventional structure. It comprises sound pressure level sensing means 11 having an input 13 for receiving ambient audio signals and an output 15 for generating an electrical signal corresponding to the audio signals. It also comprises signal processing means 5 having an audio channel input 17 connected to the output 15 of the sound pressure level sensing means for receiving and processing the electrical signal to produce a processed electrical signal and an output 33. The signal processing means 5 includes a communication port 7 through which the signal processing means 5 may be programmed. The instrument 1 further comprises output transducer means 31 having an input 35 connected to the output 33 of the signal processing means 5 and an output 37 for generating an audio signal corresponding to the processed electrical signal.

Figure 2:
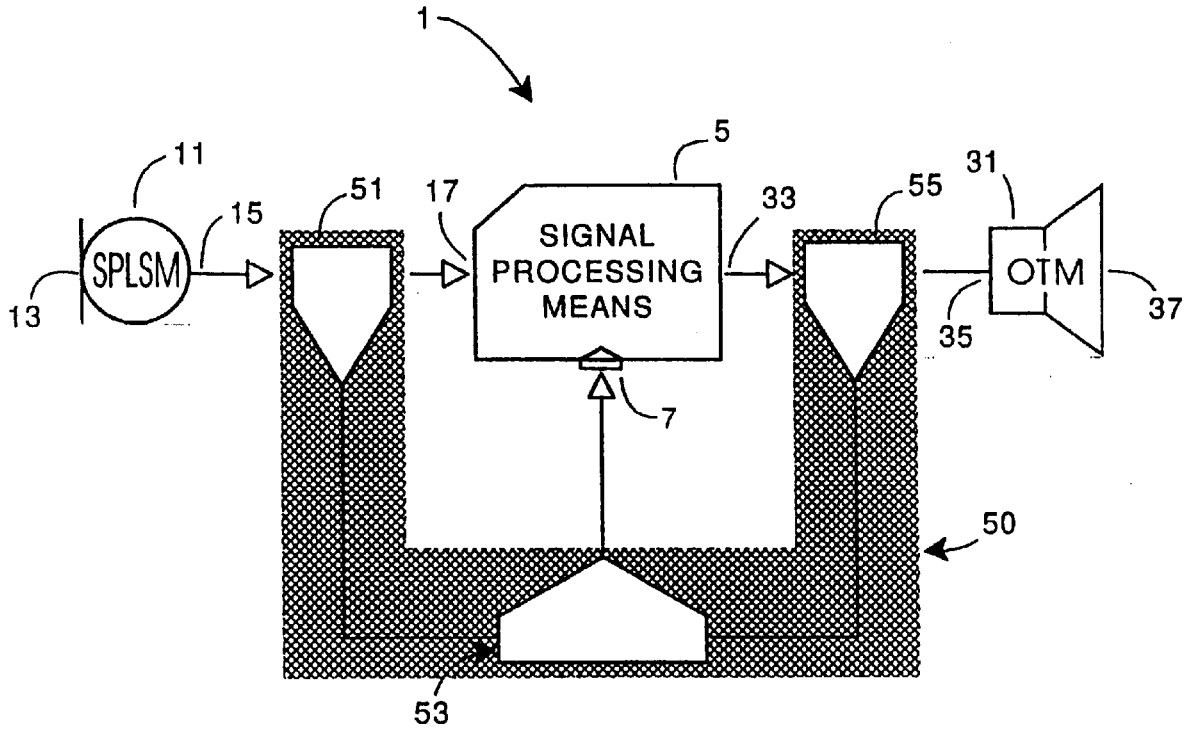
FIG. 2 is a schematic representation of an improved hearing instrument according to the invention.

In accordance with the invention, the hearing instrument 1 briefly described above is improved in that it further comprises an interface for wireless programming of the hearing instrument 1, generally denoted on FIG. 2 as 50. It should be understood that the interface for wireless programming of a hearing instrument 1 is equally applicable to an "analog" hearing instrument, or a "digital" hearing instrument. Furthermore, the terms "program" or "programming" should be understood to include not only modifying the response parameters of the signal processing means 5, but any type of communication with the signal processing means 5.

The interface 50, as shown on FIG. 2, comprises means for receiving program codes 51 operatively connected between the output 15 of the sound pressure level sensing means 11 and the audio channel input 17 of the signal processing means 5. It also comprises means for transmitting program codes 55 operatively connected between the output 33 of the signal processing means 5 and the input 35 of the output transducer means 31. A programming interface, generally denoted as 53, is operatively connected to the means for receiving program codes 51, to the means for transmitting program codes 55 and to the communication port 7 of the signal processing means 5, for translating the program codes into a programming language compatible with the programming language of the signal processing means 5 in order to program the signal processing means 5 by sending a signal to the communication port 7.

Figure 3:
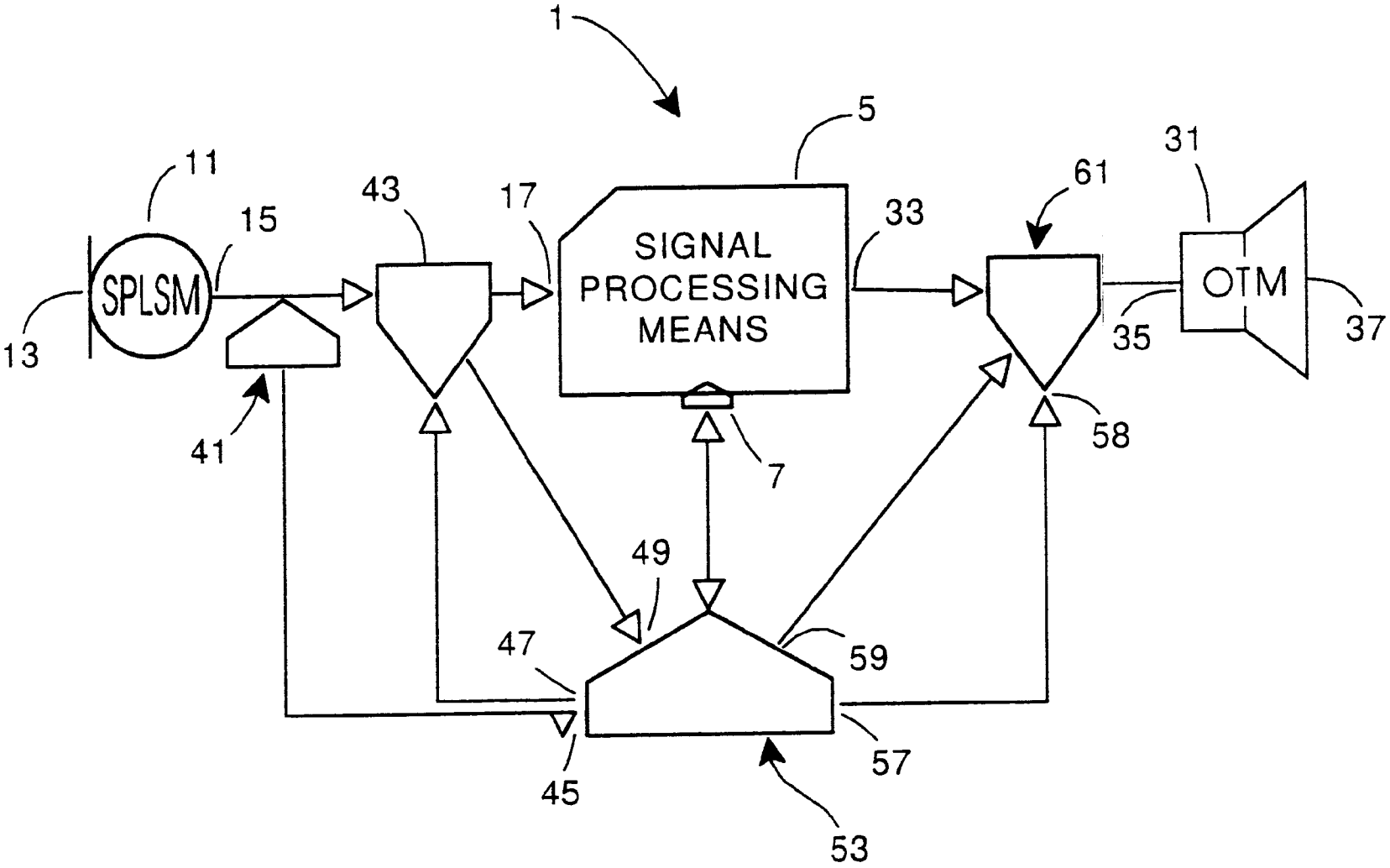
FIG. 3 is a detailed schematic representation of an improved analog hearing instrument including a watchdog unit and the first and third switches.
Figure 4:
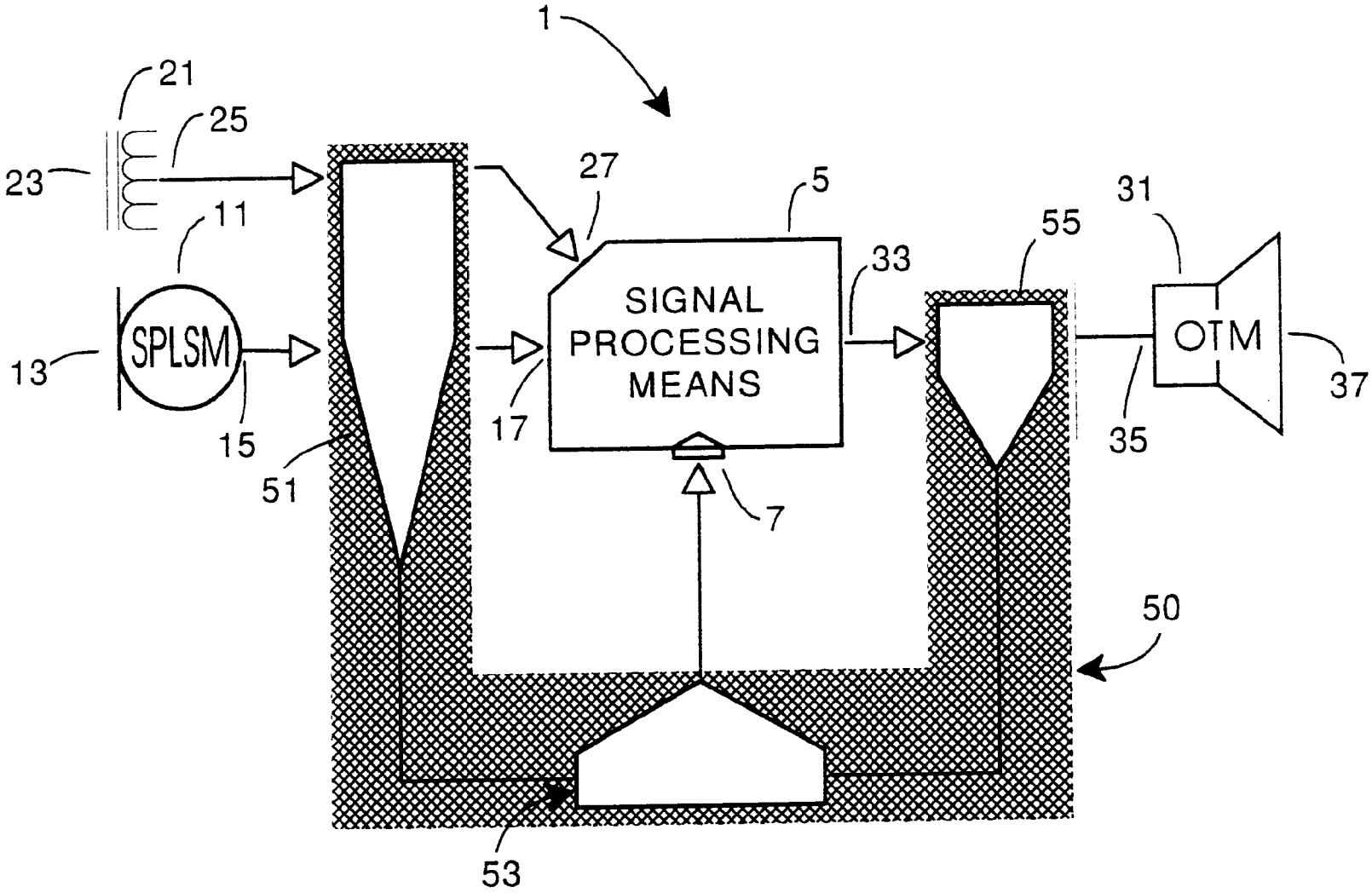
FIG. 4 is a schematic representation of another improved hearing instrument including electromagnetic transducer means.

When the hearing instrument according to the invention is of the "analog" type as illustrated on FIGS. 3 and 4, the programming interface 53 further comprises a first control input 45 and a first control output 47. The means for receiving program codes comprise a watchdog unit 41, having an output connected to the first control input 45 of the programming interface 53, for monitoring the electrical signal corresponding to the ambient audio signal in order to determine if programming codes are being received. A switch 43 is operatively connected between the output 15 of the sound pressure level sensing means 11 and the audio channel input 17 of the signal processing means 5 and has a control input connected to the first control output 47, for switching the electrical signal corresponding to the ambient audio signal between the signal processing means 5 and the programming interface 53.

In use, when the watchdog unit 41 determines that program codes are being received, it sends a signal to the programming interface 53 to indicate that program codes are being received. The programming interface 53 then sends a control signal to the switch 43 to transmit the program codes to the programming interface 53, in effect switching the transmission path from the signal processing means 5 to the programming interface 53, thereby muting the hearing instrument since the signal processing means 5 does not receive the electrical signal.

The programming interface 53, receives the program codes, translates them into a programming language compatible with the programming language of the signal processing means 5 and sends the program codes to the signal processing means 5 through the communication port 7, thereby programming the signal processing means 5.

When the watchdog unit 41 determines that program codes are no longer being received, the watchdog unit 41 sends a signal to the programming interface 53 to indicate that program codes are no longer being received. The programming interface 53 sends a control signal to the switch 43 to transmit the electrical signal to the signal processing means 5 thereby re-establishing the normal operation of the hearing instrument 1. Alternatively, when the programming interface 53 has received a signal indicating that program codes are no longer being sent or when the programming interface 53 determines that the program codes are not directed to it, the programming interface 53 sends a control signal to the switch 43 to transmit the electrical signal to the signal processing means 5.

Preferably, when program codes are being sent, they are preceded by a "leader", which the watchdog unit 41 is programmed to recognize as signalling the arrival of program codes. Preferably, the leader may also be encoded in such a manner as to indicate to the watchdog unit 41 whether the program codes are directed to the particular hearing instrument 1 or if they are directed to another hearing instrument. Also, when the programming codes are finished, they are preferably followed by a "trailer", which the watchdog unit 41 is programmed to recognize as signalling the end of the program codes. This avoids having the programming interface 53 decide whether program codes are directed to it or another hearing unit and whether all of the program codes have been received.

It can be seen that the hearing instrument 1 according to the invention may then be programmed easily by sending the appropriate codes to the hearing instrument 1 in order to modify the response parameters of the signal processing means 5.

However, in some circumstances, a hearing aid specialist may need to obtain information about the resident response parameters within the signal processing means 5 before programming the signal processing means 5. To that effect, the hearing instrument 1 also includes means for transmitting program codes 55. The programming interface 53 then includes a third control output 57 and translating means (not shown) integrated within the programming interface 53 for translating the programming language of the signal processing means 5 into a language compatible with the incoming programming codes, in order to transmit data from the signal processing means 5 through the output transducer 31. The means for transmitting program codes 55 comprise a switch 61 operatively connected between the output 33 of the signal processing means 5, the output 59 of the programming interface 53 and the input 35 of the output transducer means 11, for switching the transmission path between the signal processing means 5 and the programming interface 53. The switch 61 has a control input 58 operatively connected to the third control output 57.

In use, when a hearing aid specialist requires information about the resident response parameters within the signal processing means 5, a program code is sent to the hearing instrument 1 indicating that the programming interface 53 upload the program codes from the signal processing means 5 through the communication port 7, translate them into a language compatible with the incoming program codes, send a signal to the switch 61 to switch the transmission path from the signal processing means 5 to the programming interface 53 and output the translated program codes through the output transducer 31. In order to accomplish this, the hearing instrument must preferably be removed from the user's ear and coupled to an acoustical adapter 101, shown on FIG. 7. The acoustical adapter 101 comprises an elongated hollow member 103, defining a passage, and having two opposite ends. A generally funnel-shaped element 105 is located at one of the opposite ends, shaped to receive a hearing instrument 1. The funnel-shaped element 105 has an open-ended apex 107 in open communication with the passage 104. At the other opposite end is located a telephone coupler 109 having an open-ended area 111, also in open communication with the passage 104. In use, the user removes the hearing instrument 1 from the ear and inserts it into the funnel-shaped element 105, with the output transducer being generally located near the apex 107 of the funnel-shaped element 105. The acoustical adapter 101 is then placed near a telephone handset 121 with the funnel-shaped element placed adjacent the telephone speaker and the telephone coupler 109 placed near the telephone microphone 125. Thus, the hearing instrument 1 may receive and transmit program codes through a telephone line.

Figure 5:
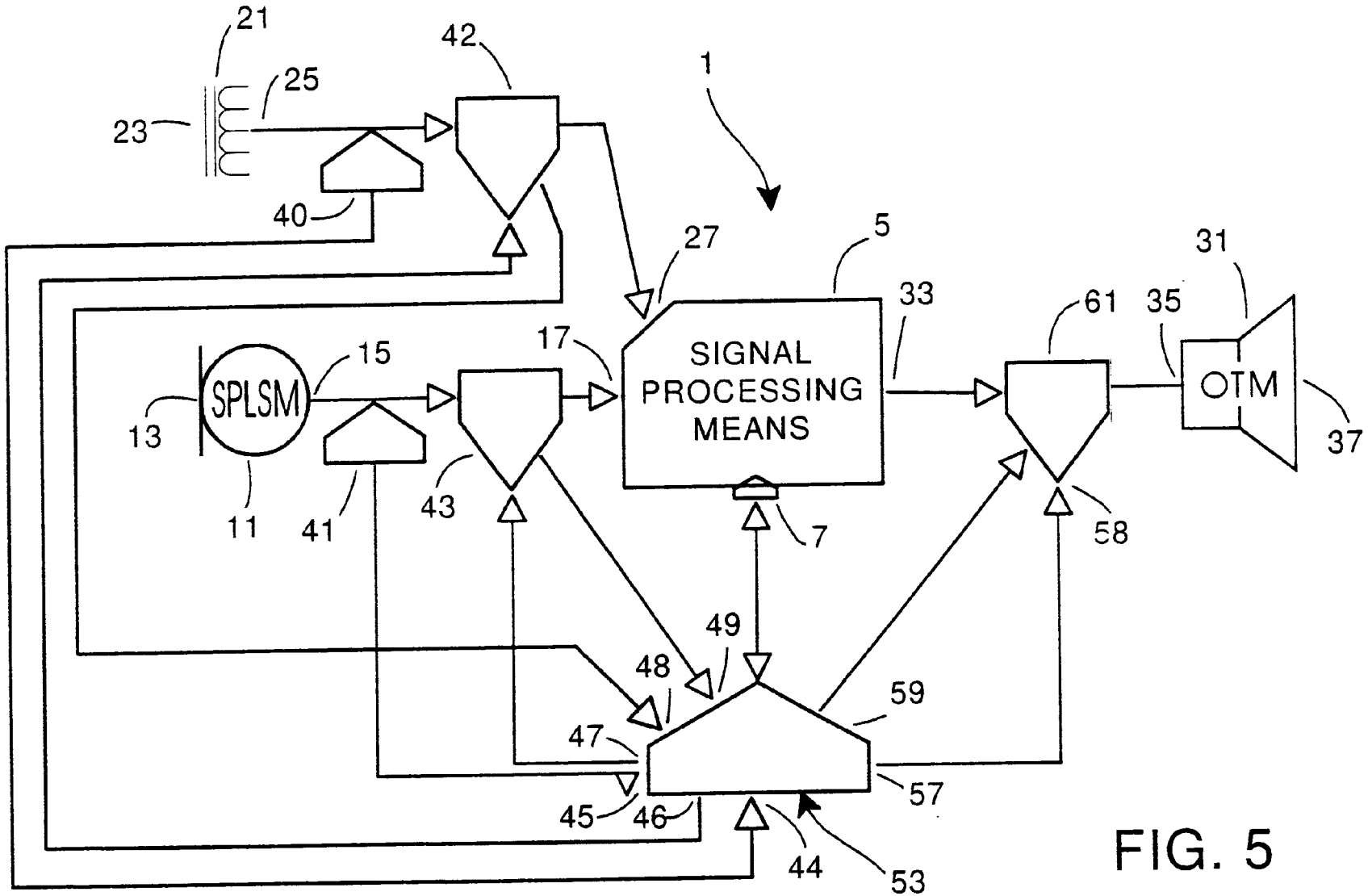
FIG. 5 is a detailed schematic representation of an improved analog hearing instrument including electromagnetic transducer means.
Figure 6:
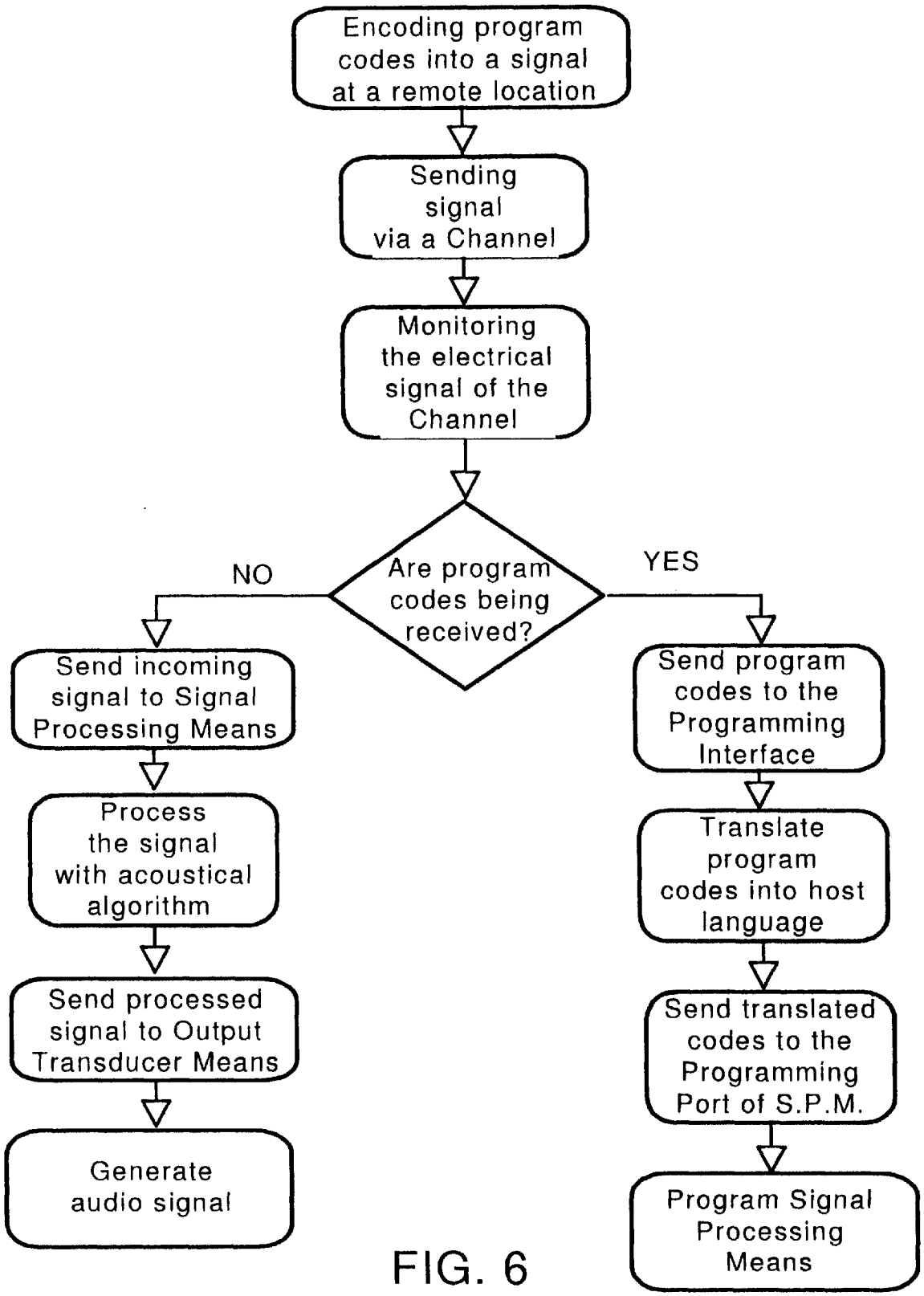
FIG. 6 is a block diagram of the method for programming the improved analog hearing instrument according to the invention.
Figure 7:
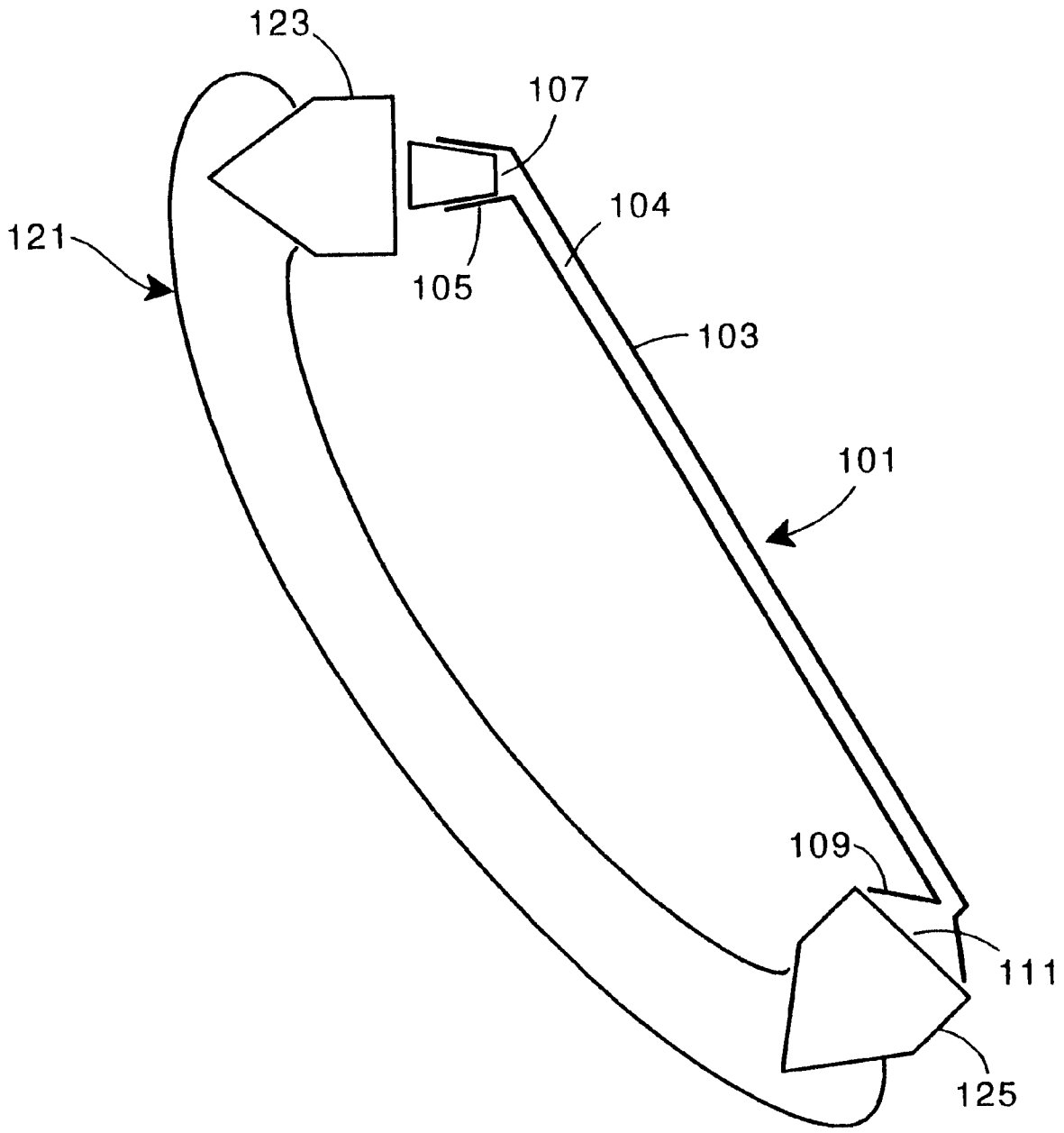
FIG. 7 is a cross-sectional view of an acoustical adapter in use with a telephone handset according to a preferred embodiment of the invention.
Figure 8:
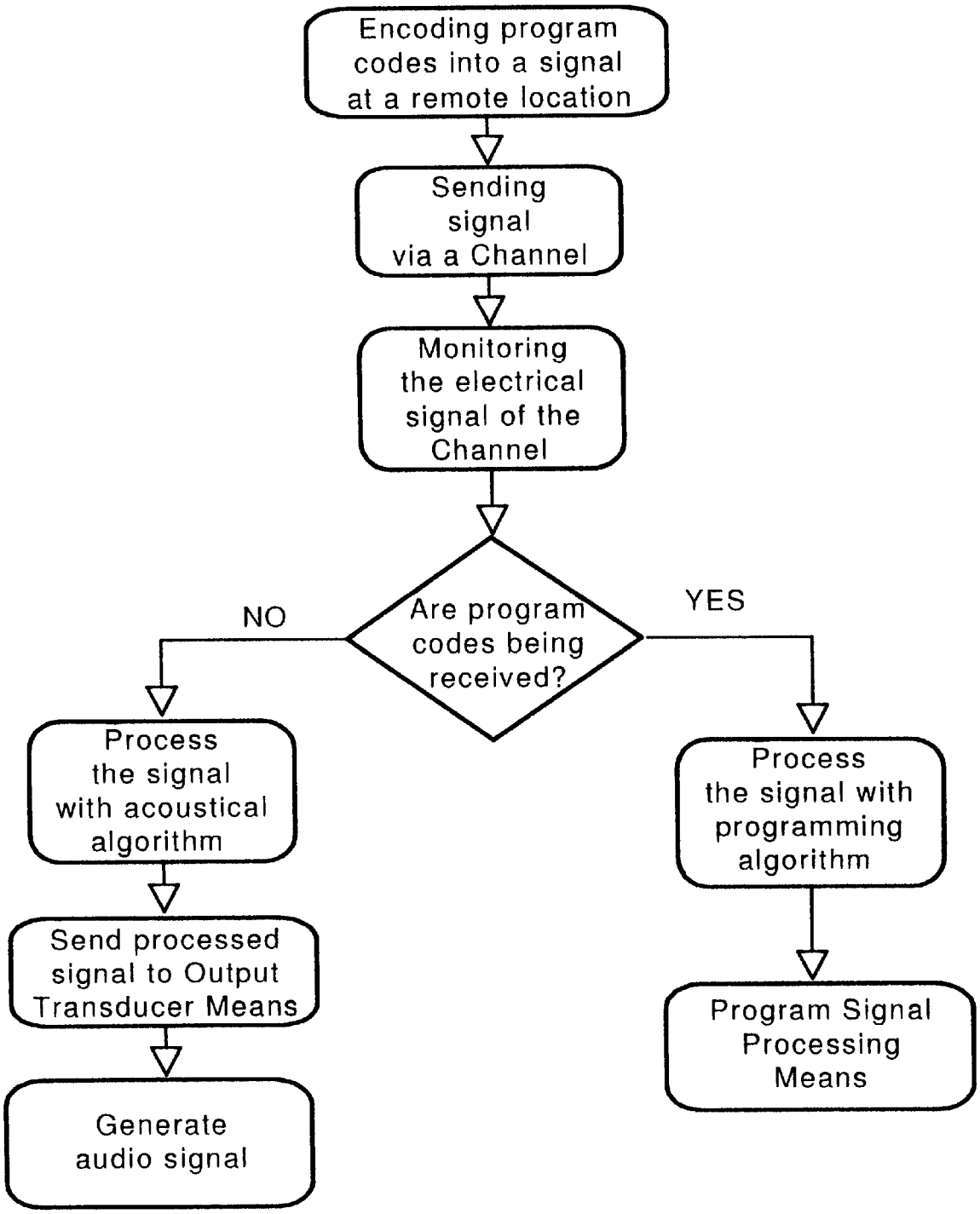
FIG. 8 is a block diagram of the method for programming an improved digital hearing instrument.

Preferably, the hearing instrument 1 further comprises an electromagnetic field sensing means 21, shown on FIGS. 4 and 5, for use particularly when a telephone set, shown on FIG. 7, is located adjacent to the hearing instrument 1 or for receiving electromagnetic field signals from any other type of emitter. The electromagnetic field sensing means 21 has an input 23 for receiving ambient electromagnetic signals and an output 25 for generating an electrical signal corresponding to the ambient electromagnetic signals. In such a case, the signal processing means 5 further comprises an electromagnetic channel input 27 operatively connected to the output 25 of the electromagnetic field sensing means 21. As shown on FIG. 5, the programming interface 53 further includes a second control input 44 and a second control output 46. The means for receiving program codes 51 are further operatively connected between the output 25 of the electromagnetic field sensing means 21 and the electromagnetic channel input 27 of the signal processing means 5. In a preferred embodiment, the means for receiving program codes further comprise a watchdog unit 40, here denoted distinctly from the watchdog unit 41 but could be the same one for both channels, for monitoring the electrical signal corresponding to the ambient electromagnetic signals and having a second output connected to the second control input 44 of the programming interface 53. The means for receiving program codes also include a second switch 42 operatively connected between the output 25 of the electromagnetic field sensing means 21 and the electromagnetic channel input 27 of the signal processing means 5, having a control input connected to the second control output 46 of the programming interface 53, for switching the electrical signal corresponding to the ambient electromagnetic field signals between the signal processing means 5 and the programming interface 53.

In use, when the watchdog unit 40 determines that program codes are being received on the electromagnetic channel, the watchdog unit 40 sends a signal to the programming interface 53 to indicate that program codes are being received. The programming interface 53 then sends a control signal to the second switch 42 to transmit the program codes to the programming interface 53, in effect switching the transmission path from the signal processing means 5 to the programming interface 53, thereby muting the hearing instrument electromagnetic channel since the signal processing means 5 does not receive the electrical signal.

The programming interface 53, receives the program codes, translates them into a programming language compatible with the programming language of the signal processing means 5 and sends the program codes to the signal processing means 5 through the communication port 7, thereby programming the signal processing means 5.

When the watchdog unit 40 determines that program codes are no longer being received, the watchdog unit 40 sends a signal to the programming interface 53 to indicate that program codes are no longer being received and the programming interface 53 sends a control signal to the second switch 42 to transmit the electrical signal to the signal processing means 5 thereby re-establishing the normal operation of the hearing instrument 1. Alternatively, when the programming interface 53 has received a signal indicating that program codes are no longer being sent or when the programming interface 53 determines that the program codes are not directed to it, the programming interface 53 sends a control signal to the second switch 42 to transmit the electrical signal to the signal processing means 5.

When the hearing instrument is of the "digital" type, the signal processing means includes at least one processing algorithm and a programming algorithm, and the interface for wireless programming of the signal processing means is functionally integrated within the signal processing means.

As such, the operation of programming the hearing instrument differs from the above description only in the fact that the digital hearing instrument does not include a physical switch as in the "analog" hearing instrument. Rather, when the watchdog unit determines that program codes are being received as above, the algorithm is changed from the processing algorithm used to process the electrical signal to the programming algorithm, used to program the digital hearing instrument. Otherwise, the "digital" hearing instrument functions in the same manner as the "analog" hearing instrument.

Further, since the "digital" hearing instrument may also include an electromagnetic field sensor, the signal processing means may further include a second processing algorithm for processing the electromagnetic channel. In some "digital" hearing instruments, the signal processing means may include a plurality of processing algorithms, each for use in particular sound conditions. In such a case, the program codes sent to program the "digital" hearing instrument would not necessarily include a complete processing algorithm, but could be indicators for the signal processing means to enable a particular processing algorithm, or to change one or more parameters within a given processing algorithm.

Given an improved hearing instrument of the types described above, programming can be effected in a number of ways, from a remote location.

For example, if a user notices a problem with the present programming of the hearing instrument, all that is required is, for example, to give a telephone call to a hearing aid specialist. The hearing aid specialist would then encode the appropriate program codes into a signal, transmit the signal over the telephone line so that it would be received by the electromagnetic field sensor 21 or the sound pressure level sensing means 11 and trigger the watchdog unit 40 or 41 into recognizing that program codes are being received either on the electromagnetic channel or the audio channel. The watchdog unit 40 or 41 then sends a signal to the programming interface 53 indicating that program codes are being received. The programming interface 53 then mutes the hearing instrument 1 so as to avoid any discomfort to the user by switching the path of the electrical signal from the signal processing means 5 to the programming interface 53 in the case of an "analog" hearing instrument or by enabling the programming algorithm in the case of a "digital" hearing instrument. Once the hearing instrument 1 is muted, the programming interface 53 translates the program codes into a language compatible with the programming language of the hearing instrument and downloads the program codes into the signal processing means 5 through the communication port 7. Once the programming is done, or when the watchdog unit 40 or 41 determines that program codes are no longer being received or when the programming interface 53 determines that programming codes are no longer being sent, the programming interface 53 restores the normal functioning of the hearing instrument 1, now programmed, by switching the path of the electrical signal from the programming interface 53 to the signal processing means 5 in the case of an "analog" hearing instrument of by restoring the processing algorithm in the case of a "digital" hearing instrument.

Of course, this programming is not only possible through a telephone line, but could be effected through, for example, the Internet, so that the program codes would be transmitted to the user's computer, and appropriately decoded by any means so as to form part of the audio signal or the electromagnetic signal of the hearing instrument.

Another manner of programming the hearing instrument according to the invention would be to use a television signal, particularly one that is used for closed-captioning of television broadcasts. In this manner, the appropriate parameters or program for a television broadcast would be encoded into the television signal. Thus, for example, if the particular broadcast includes a loud noise, such as an explosion, the television signal includes, shortly before the explosion, program codes to modify the response parameters of the hearing instrument for this loud noise. Thus, the program codes are appropriately decoded to form part of the audio or electromagnetic signal for the hearing instrument and the hearing instrument is appropriately programmed for the upcoming loud noise, so as to minimize the discomfort a user may feel.

Another advantage of the present invention is that program codes may be permanently encoded into a programming unit. For example, the acoustics of a user's house may be different from one room to another. Preferably, the programming units should be located at strategic locations around the user's house, each programmed with the appropriate program codes for each of these locations. The programming unit would intermittently or continuously send into the vicinity of the programming unit the program codes, either as part of an audio signal, or preferably as part of an electromagnetic signal. Thus, whenever the user and, by the same token, the hearing instrument would be located near the programming unit, the hearing instrument would be automatically programmed with the appropriate program codes for a given location.

In a more general manner, such programming units could advantageously be located near or around public places such as concert halls, arenas, office buildings, etc., so that hearing instruments worn by users in the vicinity of these locations are automatically and appropriately programmed. In such a case, the programming interface should be programmed in such a manner as to determine whether the program codes being received are relevant for the particular signal processing means or if they are directed to another hearing instrument.

Furthermore, if a user needs a hearing instrument in both ears, each of the signal processing means should be able to determine whether the program codes are relevant to them or rather to the other signal processing means.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. In an analog hearing instrument of the type comprising:

a sound pressure level sensing means having an input for receiving ambient audio signals and an output for generating an electrical signal corresponding to said audio signals;

a signal processing means having an audio channel input connected to the output of the sound pressure level sensing means for receiving and processing said electrical signal to produce a processed electrical signal, said processing means being programmable through a communication port and having an output for outputting said processed electrical signal; and an output transducer means having an input connected to the output of the signal processing means and an output for generating an audio signal corresponding to said processed electrical signal;

the improvement comprising an interface for wireless programming of said signal processing means, said interface comprising:

means for receiving program codes operatively connected between the output of said sound pressure level sensing means and the audio channel input of said signal processing means;

means for transmitting program codes operatively connected between the output of said signal processing means and the input of said output transducer means; and a programming interface operatively connected to said means for receiving program codes, to said means for transmitting program codes and to the communication port of said signal processing means, for translating said program codes into a programming language compatible with the programming language of said signal processing means in order to program said signal processing means by sending a signal to said communication port;

said programming interface further comprising a first control input and a first control output; and wherein said means for receiving program codes further comprise:

a watchdog unit for monitoring the electrical signal corresponding to said ambient audio signal in order to determine if programming codes are being received and having an output connected to the first control input of said programming interface; and a switch operatively connected between the output of said sound pressure level sensing means and the input of said signal processing means and having a control input connected to said first control output, for switching the electrical signal corresponding to said ambient audio signal between said signal processing means and said programming interface;

whereby:

when said watchdog unit determines that program codes are being received, said unit sends a signal to said programming interface to indicate that program codes are being received and said programming interface sends a control signal to said switch to transmit said program codes to said programming interface; and when said watchdog unit determines that program codes are no longer being received, said unit sends a signal to said programming interface to indicate that program codes are no longer being received and said programming interface sends a control signal to said switch to transmit said electrical signal to said signal processing means; or when said interface has received a signal indicating that program codes are no longer being sent, said programming interface sends a control signal to said switch to transmit said electrical signal to said signal processing means; or when said interface determines that said program codes are not relevant for said signal processing means, said programming interface sends a control signal to said switch to transmit said electrical signal to said signal processing means.

2. The improved hearing instrument of claim 1, wherein said programming interface comprises a third control output and translating means for translating said programming language of said signal processing means into a language compatible with said incoming programming codes, in order to transmit data from said signal processing means through said output transducer; and said means for transmitting program codes comprise:

another switch operatively connected between the output of said signal processing means, the output of said programming interface and the input of said output transducer means, for switching the transmission path between said signal processing means and said programming interface, said switch having a control input operatively connected to said third control output.

3. In a hearing instrument of the type comprising:

a sound pressure level sensing means having an input for receiving ambient audio signals and an output for generating an electrical signal corresponding to said audio signals;

an electromagnetic field sensing means having an input for receiving ambient electromagnetic signals and an output for generating an electrical signal corresponding to said ambient electromagnetic signals, a signal processing means having an audio channel input connected to the output of the sound pressure level sensing means and an electromagnetic channel input operatively connected to the output of said electromagnetic field sensing means, for receiving and processing said electrical signals to produce a processed electrical signal, said processing means being programmable through a communication port and having an output for outputting said processed electrical signal; and an output transducer means having an input connected to the output of the signal processing means and an output for generating an audio signal corresponding to said processed electrical signal;

the improvement comprising an interface for wireless programming of said signal processing means, said interface comprising:

means for receiving program codes operatively connected between the output of said sound pressure level sensing means and the audio channel input of said signal processing means; said means for receiving program codes being also operatively connected between the output of said electromagnetic field sensing means and the second input of said signal processing means;

means for transmitting program codes operatively connected between the output of said signal processing means and the input of said output transducer means; and a programming interface operatively connected to said means for receiving program codes, to said means for transmitting program codes and to the communication port of said signal processing means, for translating said program codes into a programming language compatible with the programming language of said signal processing means in order to program said signal processing means by sending a signal to said communication port;

said programming interface further comprising a first and second control inputs and a first and second control outputs; and wherein said means for receiving program codes further comprise:

a watchdog unit for monitoring the electrical signal corresponding to said ambient audio signal in order to determine if program codes are being received and having a first output connected to the first control input of said programming interface and for monitoring the electrical signal corresponding to said ambient electromagnetic signals and having a second output connected to the second control input of said programming interface;

a first switch operatively connected between the output of said sound pressure level sensing means and the audio channel input of said signal processing means and having a control input connected to said first control output, for switching the electrical signal corresponding to said ambient audio signal between said signal processing means and said programming interface;

a second switch operatively connected between the output of said electromagnetic field sensing means and the electromagnetic channel input of said signal processing means and having a control input connected to said second control output, for switching the electrical signal corresponding to said ambient electromagnetic field between said signal processing means and said programming interface;

whereby:

when said watchdog unit determines that program codes are being received by said sound pressure level sensing means, said unit sends a signal to said programming interface to indicate that program codes are being received and said programming interface sends a control signal to said first switch to transmit said program codes to said programming interface; and when said watchdog unit determines that program codes are no longer being received, said unit sends a signal to said programming interface to indicate that program codes are no longer being received and said programming interface sends a control signal to said first switch to transmit said electrical signal to said signal processing means; or when said programming interface has received a signal indicating that program codes are no longer being sent, said programming interface sends a control signal to said first switch to transmit said electrical signal to said signal processing means; and whereby:

when said watchdog unit determines that program codes are being received by said electromagnetic field sensing means, said unit sends a signal to said programming interface to indicate that program codes are being received and said programming interface sends a control signal to said second switch to transmit said program codes to said programming interface; and when said watchdog unit determines that program codes are no longer being received, said unit sends a signal to said programming interface to indicate that program codes are no longer being received and said programming interface sends a control signal to said second switch to transmit said electrical signal to said signal processing means; or when said programming interface has received a signal that program codes are no longer being sent, said programming interface sends a control signal to said second switch to transmit said electrical signal to said signal processing means; or when said interface determines that said program codes are not relevant for said signal processing means, said programming interface sends a control signal to said switch to transmit said electrical signal to said signal processing means.

4. The improved hearing instrument of claim 3, wherein:

said programming interface comprises a third control output and translating means for translating said programming language of said signal processing means into a language compatible with said incoming program codes, in order to transmit data from said signal processing means through said output transducer; and said means for transmitting program codes comprise:

another switch operatively connected between the output of said signal processing means, the output of said programming interface and the input of said output transducer means, for switching the transmission path between said signal processing means and said programming interface, said switch having a control input operatively connected to said third control output.

5. A method for wireless programming of a hearing instrument, said hearing instrument comprising:

a sound pressure level sensing means having an input for receiving ambient audio signals and an output for generating an electrical signal corresponding to said audio signals;

a signal processing means having an audio processing channel input connected to the output of the sound pressure level sensing means for receiving and processing said electrical signal to produce a processed electrical signal, said processing means being programmable through a communication port and having an output for outputting said processed electrical signal;

an output transducer means having an input connected to the output of the signal processing means and an output for generating an audio signal corresponding to said amplified and processed electrical signal;

an interface for wireless programming of said signal processing means and comprising:

means for receiving program codes operatively connected between the output of said sound pressure level sensing means and the input of said signal processing means;

means for transmitting program codes operatively connected between the output of said signal processing means and the input of said output transducer means; and a programming interface operatively connected to said means for receiving program codes, to said means for transmitting program codes and to the communication port of said signal processing means, for translating said program codes into a programming language compatible with the programming language of said signal processing means in order to program said signal processing means;

said method comprising the steps of:

encoding the program codes into a signal at a remote location;

sending said signal via a channel so that it may become part of said ambient audio signal for the hearing instrument;

monitoring the electrical signal corresponding to said ambient audio signal in order to determine if program codes are being received;

receiving said program codes with said means for receiving program codes;

sending said program codes from said means for receiving program codes to said programming interface;

translating said program codes with said programming interface into a language compatible with said signal processing means;

programming said signal processing means with said translated program codes by sending said translated program codes to said signal processing means through said communication port.

6. A method according to claim 5, wherein:

said hearing instrument further comprises an electromagnetic field sensing means having an input for receiving ambient electromagnetic signals and an output for generating an electrical signal corresponding to said ambient electromagnetic signals, said signal processing means further comprises an electromagnetic channel input operatively connected to the output of said electromagnetic field sensing means, and said means for receiving program codes are further operatively connected between the output of said electromagnetic field sensing means and the second input of said signal processing means; and wherein said method further comprises the steps of:

sending said signal via a channel so that it may become part of said ambient electromagnetic signals; and monitoring the electrical signal corresponding to said ambient electromagnetic signals in order to determine if program codes are being received.

7. The method according to claim 6, wherein:

said programming interface of the hearing instrument further comprises a first and second control inputs and a first and second control outputs; and said means for receiving program codes comprise:

a watchdog unit for monitoring the electrical signal corresponding to said ambient audio signal in order to determine if program codes are being received and having a first output connected to the first control input of said programming interface and for monitoring the electrical signal corresponding to said ambient electromagnetic signals and having a second output connected to the second control input of said programming interface;

a first switch operatively connected between the output of said sound pressure level sensing means and the input of said signal processing means and having a control input connected to said first control output, for switching the electrical signal corresponding to said ambient audio signal between said signal processing means and said programming interface;

a second switch operatively connected between the output of said electromagnetic field sensing means and the second input of said signal processing means and having a control input connected to said second control output, for switching the electrical signal corresponding to said ambient electromagnetic field between said signal processing means and said programming interface;

wherein said method further comprises the steps of:

monitoring the electrical signal corresponding to said ambient audio signal with said watchdog unit;

sending a signal from said watchdog unit to said programming interface when program codes are being received by said sound pressure level sensing means;

sending a control signal from said programming interface to said first switch to transmit said program codes to said programming interface;

sending a signal from said watchdog unit to said programming interface when program codes are no longer being received by said sound pressure level sensing means and sending a control signal from said programming interface to said first switch to transmit said electrical signal to said sound processing means; or sending a control signal from said programming interface to said first switch to transmit said electrical signal to said sound processing means when said programming interface has received a code indicating that program codes are no longer being sent, and monitoring said electrical signal corresponding to said ambient electromagnetic signals with said watchdog unit;

sending a signal from said watchdog unit to said programming interface when program codes are being received by said electromagnetic field sensing means;

sending a control signal from said programming interface to said second switch to transmit said program codes to said programming interface;

sending a signal from said watchdog unit to said programming interface when program codes are no longer being received by said electromagnetic field sensing means and sending a control signal from said programming interface to said second switch to transmit said electrical signal to said sound processing means; or sending a control signal from said programming interface to said second switch to transmit said electrical signal to said sound processing means when said programming interface has received a code indicating that program codes are no longer being sent.

8. A method according to claim 7, wherein said channel is a broadcasting network.

9. A method according to claim 7, wherein said channel is part of a television signal.

10. A method according to claim 7, wherein said signal is encoded into an analog stream.

11. A method according to claim 7, wherein said signal is encoded into a digital stream.

12. A method according to claim 7, wherein said signal is sent to a given location, whereby whenever said hearing instrument is located in the vicinity of said location, said hearing instrument is automatically programmed.

13. A method according to claim 12, wherein said signal is continuously sent to said given location.

14. A method according to claim 12, wherein said signal is intermittently sent to said given location.

15. A method according to claim 7, further comprising the steps of:

permanently encoding said program codes into a programming unit;

locating said unit at a given location; and continuously emitting said program codes from said programming unit.

16. The method according to claim 7, wherein:

said programming interface of the instrument comprises a third control output; and said means for transmitting program codes comprise:

translating means having an input operatively connected to the output of said programming interface and an output, for translating said programming language of said signal processing means into a language compatible with said incoming program codes, in order to transmit data from the communication port of said signal processing means to the channel through said output transducer;

a switch operatively connected between the output of said signal processing means, the output of said programming interface and the input of said output transducer means, for switching the transmission path between said signal processing means and said programming interface, said switch having a control input operatively connected to said third control output;

wherein said method further comprises the steps of:

translating said programming language of said signal processing means into a language compatible with said program codes;

sending a control signal to said switch in order to establish the transmission path between said programming interface and said output transducer; and transmitting data from said programming interface through said output transducer.

17. A method according to claim 16, further comprising the step of:

coupling said output transducer of said hearing instrument to an acoustical adapter for transmitting said program codes over said channel, wherein said acoustical adapter comprises:

an elongated hollow member defining a passage and having two opposite ends;

a generally funnel-shaped element located at one of said opposite ends, said funnel shaped-element being shaped to receive said hearing instrument and having an open-ended apex in open communication with said passage;

a telephone coupler located at the other of said opposite ends, said telephone coupler having an open-ended area in open communication with said passage;

whereby said hearing instrument can be inserted into said funnel-shaped element with said output transducer located near said funnel-shaped element apex in order to provide bi-directional communication with a telephone handset having a speaker and a microphone, by placing said hearing instrument near said speaker and by placing said suction cup on said microphone.

18. A method according to claim 16, wherein said channel is a switched network.

19. A method according to claim 16, wherein said signal is encoded into an analog stream.

20. A method according to claim 16, wherein said signal is encoded into a digital stream.

21. The method according to claim 5, wherein:

said hearing instrument is digital;

said signal processing means include at least one processing algorithm and a programming algorithm; and said interface for wireless programming of said programmable signal processing means is functionally integrated into said signal processing means.

22. The method according to claim 21, wherein:

said hearing instrument further comprises an electromagnetic field sensing means having an input for receiving ambient electromagnetic signals and an output for generating an electrical signal corresponding to said ambient electromagnetic signals;

said signal processing means further comprises an electromagnetic channel input operatively connected to the output of said electromagnetic field sensing means; and said means for receiving program codes are further operatively connected between the output of said electromagnetic field sensing means and the electromagnetic channel input of said signal processing means; and wherein said method further comprises the steps of:

sending said signal via a channel so that it may become part of said ambient electromagnetic signal for the hearing instrument; and monitoring the electrical signal corresponding to said ambient electromagnetic signals in order to determine if program codes are being received.

23. The method according to claim 22, wherein:

said means for receiving program codes comprise:

a watchdog unit for monitoring the electrical signal corresponding to said ambient audio signal and the electrical signal corresponding to said ambient electromagnetic field signal wherein said method further comprises the steps of monitoring the electrical signal corresponding to said ambient audio signal and the electrical signal corresponding to said ambient electromagnetic field signal;

disabling said processing algorithm and enabling said programming algorithm when program codes are being received by said sound pressure level sensing means or said electromagnetic field sensing means;

disabling said programing algorithm and enabling said processing algorithm when program codes are no longer being received or when said programming algorithm receives a signal that program codes are no longer being sent or when said programming algorithm determines that said program codes are not relevant to said signal processing means.

24. A method according to claim 23, further comprising the step of:

coupling said output transducer of said hearing instrument to an acoustical adapter for transmitting said program codes over said channel, wherein said acoustical adapter comprises:

an elongated hollow member defining a passage and having two opposite ends;

a generally funnel-shaped element located at one of said opposite ends, said funnel shaped-element being shaped to receive said hearing instrument and having an open-ended apex in open communication with said passage;

a telephone coupler located at the other of said opposite ends, said telephone coupler having an open-ended area in open communication with said passage;

whereby said hearing instrument can be inserted into said funnel-shaped element with said output transducer located near said funnel-shaped element apex in order to provide bi-directional communication with a telephone handset having a speaker and a microphone, by placing said hearing instrument near said speaker and by placing said suction cup on said microphone.

25. A method according to claim 23, wherein said channel is a switched network.

26. A method according to claim 23, wherein said channel is a broadcasting network.

27. A method according to claim 23, wherein said channel is part of a television signal.

28. A method according to claim 23, wherein said signal is encoded into an analog stream.

29. A method according to claim 23, wherein said signal is encoded into a digital stream.

30. A method according to claim 23, wherein said signal is sent to a given location, whereby whenever said hearing instrument is located in the vicinity of said location, said hearing instrument is automatically programmed.

31. A method according to claim 30, wherein said signal is continuously sent to said given location.

32. A method according to claim 30, wherein said signal is intermittently sent to said given location.

33. A method according to claim 23, further comprising the steps of:

permanently encoding said program codes into a programming unit;

locating said unit at a given location; and continuously emitting said program codes from said programming unit.

34. In a digital hearing instrument of the type comprising:

a sound pressure level sensing means having an input for receiving ambient audio signals and an output for generating an electrical signal corresponding to said audio signals;

a signal processing means having an audio channel input connected to the output of the sound pressure level sensing means for receiving and processing said electrical signal to produce a processed electrical signal, said processing means being programmable through a communication port and having an output for outputting said processed electrical signal, said signal processing means including at least one processing algorithm and a programming algorithm; and an output transducer means having an input connected to the output of the signal processing means and an output for generating an audio signal corresponding to said processed electrical signal;

the improvement comprising an interface for wireless programming of said signal processing means, said interface being functionally integrated into said signal processing means and comprising:

means for receiving program codes operatively connected between the output of said sound pressure level sensing means and the audio channel input of said signal processing means;

means for transmitting program codes operatively connected between the output of said signal processing means and the input of said output transducer means; and a programming interface operatively connected to said means for receiving program codes, to said means for transmitting program codes and to the communication port of said signal processing means, for translating said program codes into a programming language compatible with the programming language of said signal processing means in order to program said signal processing means by sending a signal to said communication port;

said means for receiving program codes comprising a watchdog unit for monitoring the electrical signal corresponding to said ambient audio signal in order to determine if program codes are being received, whereby when said watchdog unit determines that program codes are being received, said unit disables said processing algorithm and enables said programming algorithm and when said unit determines that program codes are no longer being received, said unit disables said programming algorithm and enables one of said processing algorithms, or when said programming algorithm receives a signal that program codes are no longer being sent or are not relevant for said signal processing means, said interface disables said programming algorithm and enables said processing algorithm.

35. The improved hearing instrument of claim 34, wherein said programming interface comprises translating means for translating said programming language of said signal processing means into a language compatible with said incoming program codes, in order to transmit data from said signal processing means through said output transducer.

36. The improved hearing instrument of claim 34, wherein:

said hearing instrument further comprises an electromagnetic field sensing means having an input for receiving ambient electromagnetic signals and an output for generating an electrical signal corresponding to said ambient electromagnetic signals;

said signal processing means further comprises an electromagnetic channel input functionally connected to the output of said electromagnetic field sensing means; and said means for receiving program codes are further functionally connected between the output of said electromagnetic field sensing means and the electromagnetic channel input of said signal processing means.

37. The improved hearing instrument of claim 36, wherein said watchdog unit monitors the electrical signal corresponding to said ambient audio signal and the electrical signal corresponding to said ambient electromagnetic field signal in order to determine if program codes are being received by said audio channel or said electromagnetic channel, whereby when said watchdog unit determines that program codes are being received on said audio channel or said electromagnetic channel, said unit disables said processing algorithm for the audio or electromagnetic channel and enables said programming algorithm and when said unit determines that program codes are no longer being received, said unit disables said programming algorithm and enables one of said processing algorithms, or when said programming algorithm receives a signal that program codes are no longer being sent or determines that said program codes are not relevant to said signal processing means, said interface disables said programming algorithm and enables one of said processing algorithms.

38. The improved hearing instrument of claim 37, wherein said programming interface comprises translating means for translating said programming language of said signal processing means into a language compatible with said incoming program codes, in order to transmit data from said signal processing means through said output transducer.

* * * * *